US007648388B2

(12) United States Patent
Kanazawa et al.

(10) Patent No.: US 7,648,388 B2
(45) Date of Patent: Jan. 19, 2010

(54) COMMUNICATION RELAY APPARATUS AND RELAY CONNECTOR UNIT

(75) Inventors: Akiyoshi Kanazawa, Susono (JP); Takashi Gohara, Susono (JP); Ken Ito, Susono (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/047,347

(22) Filed: Mar. 13, 2008

(65) Prior Publication Data

US 2008/0293266 A1 Nov. 27, 2008

(30) Foreign Application Priority Data

May 23, 2007 (JP) ..... 2007-136935

(51) Int. Cl.
*H01R 27/00* (2006.01)
*H01R 29/00* (2006.01)

(52) U.S. Cl. ..... 439/516; 439/189; 439/507

(58) Field of Classification Search ..... 439/488, 439/516, 507, 509, 510, 189
See application file for complete search history.

(56) References Cited

U.S. PATENT DOCUMENTS 5,290,191 A 3/1994 Foreman et al.
6,447,331 B1 * 9/2002 Fukatsu et al. ..... 439/516
6,837,725 B1 1/2005 Gordon et al.
7,297,029 B2 * 11/2007 Ueno et al. ..... 439/620.21

FOREIGN PATENT DOCUMENTS

DE 19851739 A1 5/2000
FR 2763718 A1 11/1998
JP 2005-285411 A 10/2005

OTHER PUBLICATIONS

Extended European Search Report dated for Jun. 16, 2009.

* cited by examiner

*Primary Examiner*—Hae Moon Hyeon
(74) *Attorney, Agent, or Firm*—Sughrue Mion, PLLC

(57) ABSTRACT

A communication relay apparatus includes a first connecting section for connecting to a first wire harness connected to an electronic control device, a second connecting section for connecting to a second wire harness connected to a plurality of electronic equipments, a communication address setting section which has a plurality of connection portions and sets a communication address for the electronic control device with a conducting pattern based on presence or absence of conduction at the connection portions, and a communication relay section which is electrically connected to the first connecting section and the second connecting section, and relays communication between the electronic control device and the electronic equipments on the basis of the communication address.

4 Claims, 6 Drawing Sheets

COMMUNICATION RELAY APPARATUS AND RELAY CONNECTOR UNIT

CROSS-REFERENCE TO RELATED APPLICATION

This application claims the benefit of Japanese Patent Application No. 2007-136935, filed on May 23, 2007, in the Japanese Intellectual Property Office.

BACKGROUND

This invention relates to a communication relay apparatus and a relay connector unit for controlling a plurality of electronic equipments by one electronic control device.

Various electrical equipments such as motors of an air-conditioner, wipers, power windows, etc., are mounted on a vehicle such as a passenger car and a truck. A wire harness is provided for supplying electric power and control signals to the electrical equipments. The wire harness includes a plurality of wires, and connectors connected to ends of the wires. The wire is a so-called sheathed wire including an electrically-conductive core wire (or conductor) and an insulative sheath covering the conductor.

As the connector of the above wire harness, there has been used a function-containing connector (see, for example, Patent Literature 1) (containing a circuit element, etc.) for connecting electrical equipments such as various actuators to an electronic control device such as a computer by a data communication network. In the function-containing connector of this kind, a lead frame having the circuit element, etc., mounted thereon is received within a housing.

The function-containing connector disclosed in Patent Literature 1 includes at least one connection portion for communication address-setting purposes, at least one electrode portion set to the ground potential in a removable manner and electrically connected to the corresponding connection portion, and a CPU (central processing unit) accepts the setting of a communication address on the basis of a potential level of each connection portion. The electrode portion is removed according to the communication address to be set, and the connection portion to be conductively connected to the electrode portion is determined, thereby effecting the address setting.

[Patent Literature 1] JP-A-2005-285411

In the case where communications were performed with a plurality of function-containing connectors connected to a common communication line, communication addresses and ID (identification data) were, for example, beforehand set in a contained circuit, or beforehand stored in a nonvolatile memory or the like in such a manner that the communication addresses and ID could be set as described above, and by doing so, signals could be transmitted and received between the function-containing connectors. However, the function-containing connectors need to set the ID, etc., independently of each other, and if these connectors had the same appearance, there was a possibility that an erroneous connection was made. Therefore, the function-containing connectors used in the communication system were made different in shape and appearance from each other, and by doing so, the erroneous mounting was prevented. Furthermore, if the function-containing connectors were identical or similar in shape, etc., to each other, each function-containing connector could not be distinguished from the other function-containing connectors at the time of mounting the connectors, and therefore there was a risk that the produced system was defective. Therefore, there has been encountered a problem that the function-containing connectors could not have the same shape, and since this problem has not been solved, the number of kinds of function-containing connectors could not be reduced, and a common design for these connectors could not be achieved, and therefore the costs of the component parts could not be reduced.

SUMMARY

With the foregoing in view, it is an object of this invention to provide a communication relay apparatus and a relay connector unit, in which an erroneous assembling is prevented, and also a common design can be achieved.

The above object has been achieved by a communication relay apparatus of the invention, comprising:

a first connecting section for connecting to a first wire harness connected to an electronic control device;

a second connecting section for connecting to a second wire harness connected to a plurality of electronic equipments;

a communication address setting section which has a plurality of connection portions and sets a communication address for the electronic control device with a conducting pattern based on presence or absence of conduction at the connection portions; and a communication relay section which is electrically connected to the first connecting section and the second connecting section, and relays communication between the electronic control device and the electronic equipments on the basis of the communication address, wherein the communication address setting section is formed so that the presence or absence of the conduction of the connection portions can be viewed from the exterior and that the conducting pattern can be set from the exterior.

In the above configuration, after the wire harness is connected to the first connecting section, the conducting pattern of the plurality of connection portions can be set or changed, and besides this conducting pattern can be visually confirmed from the exterior.

Preferably, the communication address setting section includes a conducting terminal which is detachably mounted on the connection portions and is capable of setting the presence or absence of the conduction of the connection portions.

In the above configuration, the presence or absence of the conduction of the connection portions can be set or changed by the conducting terminal, and besides the conducting pattern can be confirmed by viewing the presence or absence of this conducting terminal.

According to the present invention, there is also provided a relay connector unit comprising:

the communication relay apparatus; and a housing which receives the communication relay apparatus therein so that the communication relay apparatus is capable of electrically connecting to the first wire harness and the second wire harness, wherein the housing includes an exposing section for exposing the communication address setting section of the communication relay apparatus so that the communication address setting section can be viewed from the exterior.

In the above relay connector unit, when the communication relay apparatus is received in the housing, the communication address setting section is exposed through the exposing section so that it can be viewed from the exterior.

As described above, in the communication relay apparatus and the relay connector unit, for example, at the time of connecting the first wire harness to the first connecting section or at a later time, the conducting pattern of the plurality of connection portions can be set or changed, and besides this conducting pattern can be visually confirmed from the exterior. Therefore, the plurality of communication relay apparatuses can be formed into a common design before the first wire harness is connected to each communication relay apparatus. Furthermore, the conducting pattern can be visually confirmed from the exterior, and therefore the efficiency of the assembling operation can be enhanced, and besides abnormality due to the erroneous assembling and others can be prevented from occurring. Therefore, the erroneous assembling can be prevented, and besides the common design can be achieved.

Also, in addition to the above advantages, the presence or absence of the conduction at the connection portions of the communication address setting section can be set by the conducting terminal, and besides the presence or absence of this conducting terminal can be viewed, and therefore even if an error should be made in the setting of the communication address during the assembling operation, an abnormal portion in the setting operation can be identified by visually confirming the conducting pattern, and the communication relay apparatus can be reused when changing the conducting pattern, and therefore the productivity and the efficiency of the maintenance can be enhanced.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF EXEMPLARY EMBODIMENTS

A communication relay apparatus and a relay connector unit provided in accordance with one preferred embodiment of the present invention will now be described with reference to FIGS. 1 to 11.

First Embodiment

Figure 1:
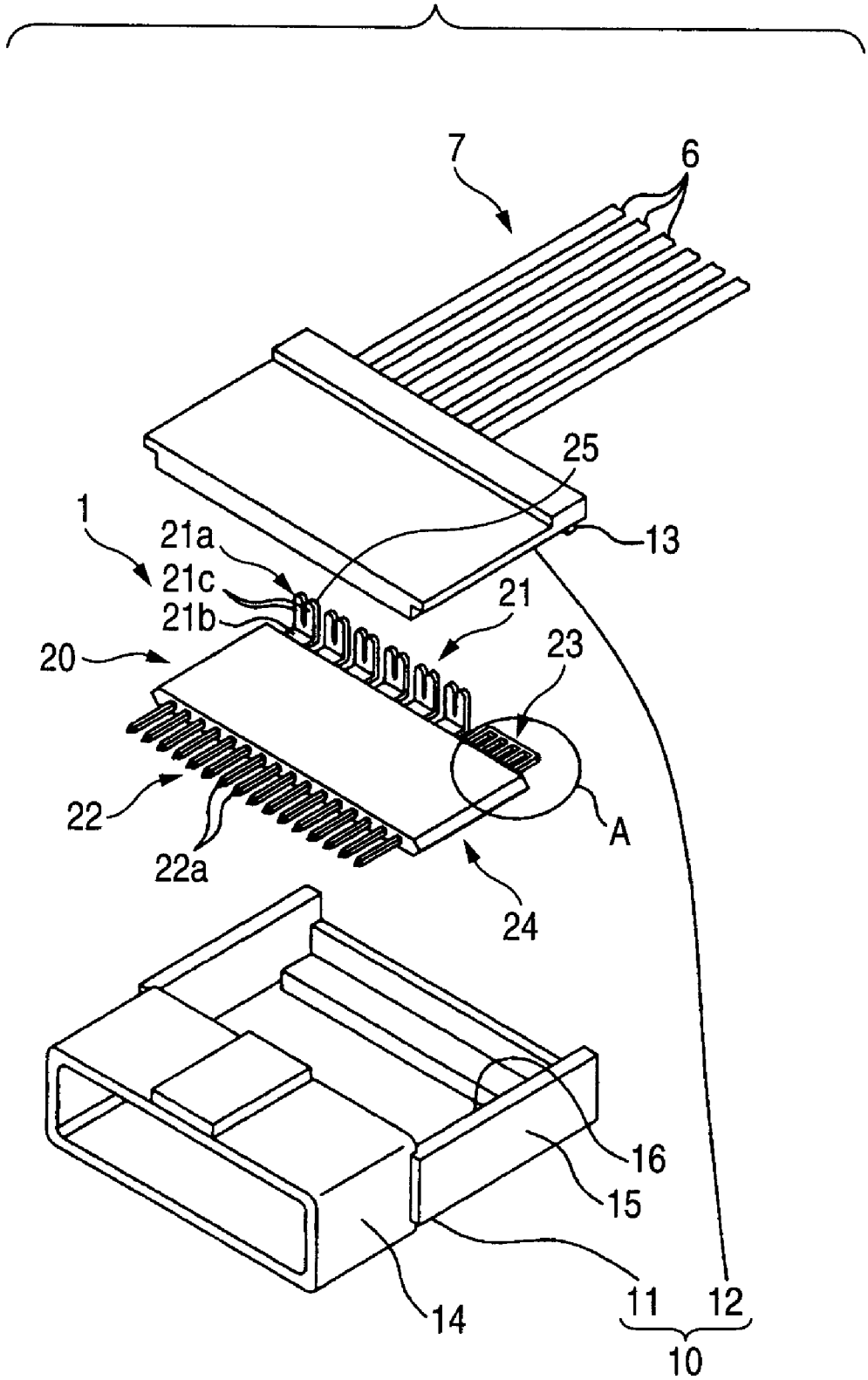
FIG. 1 is an exploded perspective view of a relay connector unit of a communication relay apparatus according to a first embodiment of the present invention.
Figure 2:
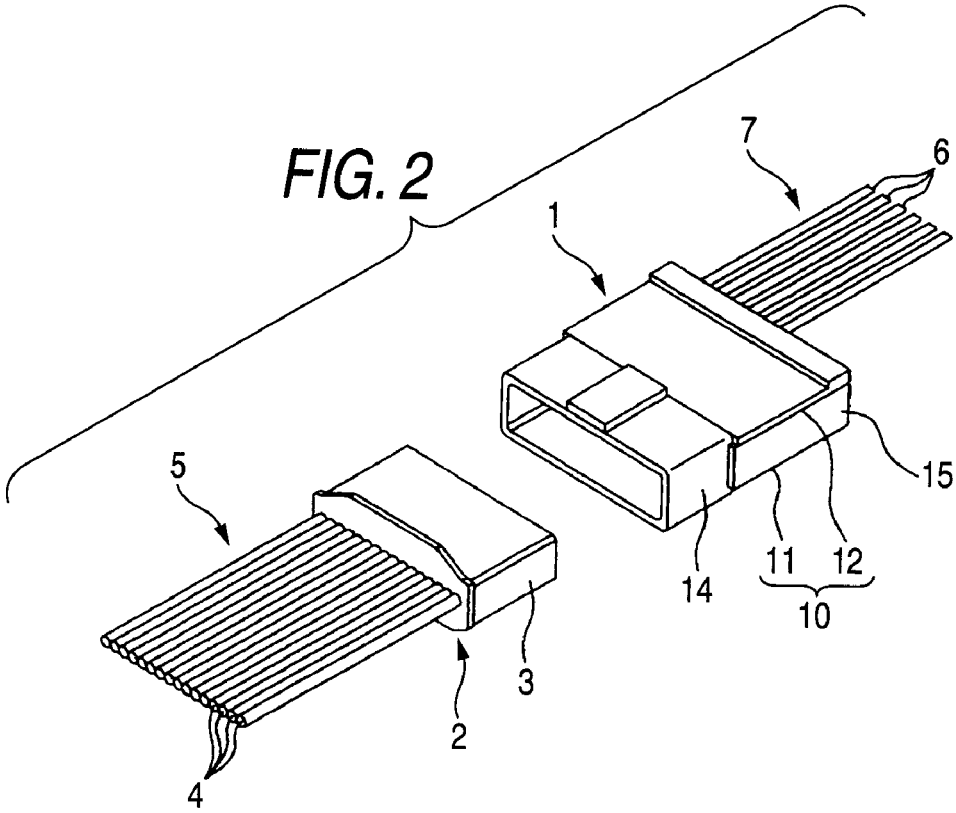
FIG. 2 is a perspective view showing the relay connector unit of FIG. 1 in a non-fitted condition.
Figure 3:
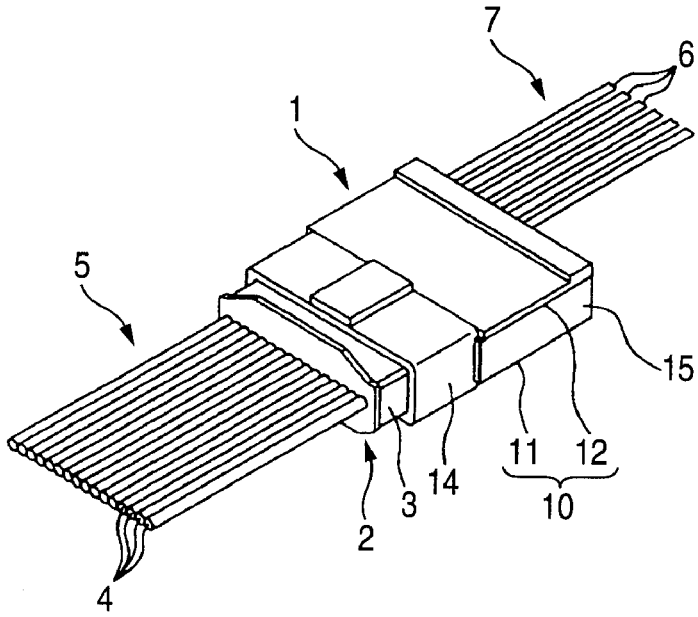
FIG. 3 is a perspective view showing the relay connector unit of FIG. 1 in a fitted condition.

In FIGS. 1 to 3, the relay connector unit 1 is fitted to a mating connector 2. The mating connector 2 includes a connector housing 3, and metal terminals (not shown). The connector housing 3 is made of an insulative synthetic resin, and is formed into a flattened box-like shape. The connector housing 3 receives the plurality of metal terminals therein. A second wire harness 5 includes a plurality of wires 4 each comprising a conductor and a sheath covering the conductor, and this wire harness 5 is connected to the metal terminals. The metal terminals are electrically connected respectively to the conductors of these wires 4.

The relay connector unit 1 includes a housing 10, a communication relay apparatus 20 received in the housing 10. The housing 10 is formed into a flattened box-like shape, and includes a unit housing 11, a cover portion 12, and a wire holding portion 13.

The unit housing 11 is made of an insulative synthetic resin, and includes a tubular hood portion 14, and a receiving chamber portion 15 formed integrally with and extending from the hood portion 14. The connector housing 3 of the mating connector 2 is inserted into the hood portion 14, and therefore the mating connector 2 is fitted into this hood portion 14. The receiving chamber 15 has a generally U-shaped cross-section, and has an opening 16 at its upper side (in FIG. 1).

The cover portion 12 is made of an insulative synthetic resin, and is formed into a flat plate-like shape. The cover portion 12 is attached to the unit housing 11. The cover portion 12, when attached to the unit housing 11, closes the opening 16.

The wire holding portion 13 has a plurality of wire receiving grooves (not shown) formed in the cover portion 12. The plurality of wire receiving grooves are arranged at intervals, and hold wires 6 in such a manner that the wires 6 pass through the corresponding wire receiving grooves. For providing means for holding the wire, for example, a diameter of the wire receiving groove is made slightly smaller than a diameter of the wire, or retaining projections for preventing withdrawal of the wire are formed on an inner surface of the wire receiving groove.

The housing 10 receives the communication relay apparatus 20 in such a manner that this communication relay apparatus 20 is located between the unit housing 11 and the cover portion 12. In the wire holding portion 13, one wire 6 is held in two of the plurality of wire receiving grooves which are disposed respectively at opposite side portions of the cover portion 12, and this wire 6 is turned into a U-shape within the housing 10. Further, another wire 6 is held in other two wire receiving grooves than the wire receiving grooves holding the above-mentioned one wire 6, and the other wires 6 are held respectively in the remaining wire receiving grooves. However, the arrangement of terminals and the U-turn installation or others can be suitably determined according to the construction of the circuit.

As shown in FIGS. 1 to 5, the communication relay apparatus 20 includes a first connecting section 21 for connection to a first wire harness 7 connected to an electronic control device 30, a second connecting section 22 for connection to the second wire harness 5 connected to a plurality of electronic equipments 40, a communication address setting section 23 for setting a communication address for the electronic control device 30 by a conducting pattern based on presence or absence of conduction at a plurality of connection portions 23*a*, and a communication relay section 24 which is electrically connected to the first connecting section 21 and the second connecting section 22 and relays communication between the electronic control device 30 and the plurality of electronic equipments 40 on the basis of the communication address set by the communication address setting section 23.

The first connecting section 21 includes a plurality of (six in FIG. 1) press-contacting terminals 21*a*. Each press-contacting terminal 21*a* includes a parallel portion 21*b*, and an upstanding portion 21*c* integral with the parallel portion 21*b*. The parallel portion 21*b* has a strip-like shape, and its opposite sides (faces) are disposed generally in coplanar relation to opposite sides (faces) of the communication relay section 24, respectively. The parallel portions 21*b* of the plurality of press-contacting terminals 21*a* are disposed parallel to one another. The parallel portions 21*b* of these press-contacting terminals 21*a* are arranged at intervals.

The upstanding portion 21*c* of each press-contacting terminal 21*a* extends upwardly from that end of the parallel portion 21*b* remote from the communication relay section 24. Opposite sides (faces) of the upstanding portion 21*c* are disposed perpendicular to the opposite sides of the parallel portion 21*b*. The upstanding portion 21*c* has a pair of press-contacting blades 25 spaced from each other in a direction of a width of the press-contacting terminal 21*a*, that is, in a direction of juxtaposition of the plurality of press-contacting terminals 21*a*. The pair of press-contacting blades 25 hold the wire 6 therebetween, and cut a sheath of the wire 6, and is brought into contact with a conductor of the wire 6.

The second connecting section 22 includes a plurality of lead frames 22*a* made of electrically-conductive metal. The plurality of lead frames 22*a* are disposed parallel to one another, and project from an edge of the communication relay section 24, and are arranged at predetermined intervals.

As shown in FIG. 1, the communication address setting section 23 is formed integrally on the communication relay section 24, and more specifically projects outwardly from a side edge of the communication relay section 24 in parallel relation to the parallel portions 21*b* of the first connecting section 21 so that communication address setting section 23 can be viewed from the exterior. As shown in FIGS. 1 to 4, the communication address setting section 23 includes the plurality of (three in the drawings) connection portions 23*a*, and an interconnecting portion 23*b*, and is formed into an integral construction, using an electrically-conductive material. Each of the connection portions 23*a* has a strip-like shape, and these connection portions 23*a* are electrically connected at their one ends to setting terminals 24*a*1 to 24*a*3 of the communication relay section 24, respectively, and are integrally connected at the other ends thereof to the interconnecting portion 23*b*. The plurality of connection portions 23*a* are arranged at intervals in the direction of juxtaposition thereof.

In this embodiment, there are provided the three connection portions 23*a*, and therefore eight communication addresses (0 to 7) in terms of binary numbers are set. However, when it is desired to provide more than eight communication addresses to be set, this can be met by providing more than three connection portions 23*a*.

Figure 4:
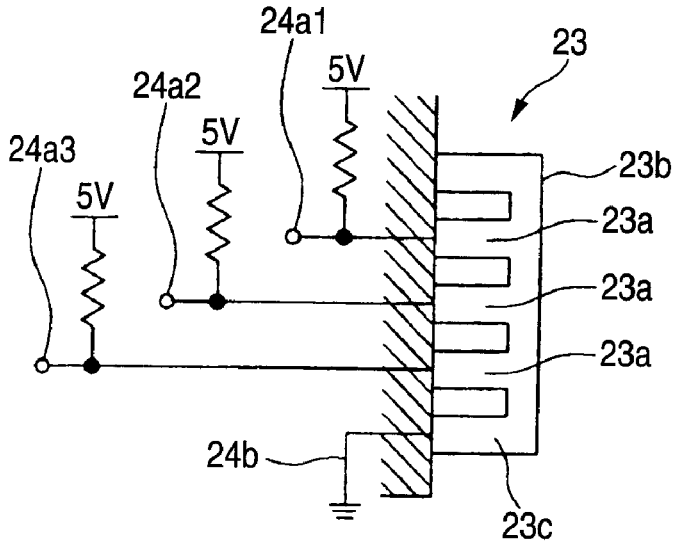
FIG. 4 is a diagrammatic illustration explanatory of a construction of a portion A of FIG. 1.

The interconnecting portion 23*b* is in the form of a U-shaped strip, and an end portion 23*c* thereof is electrically connected to a grounding line 24*b* of the communication relay section 24. Namely, when all of the connection portions 23*a* exist (that is, are present) as shown in FIG. 4, a predetermined voltage (for example, 5V) is applied to these connection portions 23*a*. In this case, each of the connection portions 23 is grounded via the grounding line 24*b*, and therefore its potential is held at a low level. Namely, in the communication relay section 24, when the connection portions 23*a* exist, the corresponding setting terminals 24*a*1 to 24*a*3 are detected as the low level.

On the other hand, when one or more of the connection portions 23*a* are removed by cutting or other means, the connection portion or portions 23*a* are not electrically connected to the grounding line 24*b* via the interconnecting portion 23*b*, and therefore their potential is held at the high level. Namely, in the communication relay section 24, when the connection portion 23*a* is removed, the corresponding setting terminal (24*a*1 to 24*a*3) is detected as the high level.

Thus, the communication address setting section 23 is constructed such that it can set the communication address for the electronic control device 30 by the conducting pattern based on the presence or absence of the plurality of connection portions 23*a* and that the presence or absence of the conduction of the plurality of connection portions 23*a* can be viewed from the exterior.

The communication relay section 24 can be formed using any suitable part such for example as an integrated circuit, a component comprising a plurality of discrete elements, a microprocessor, a DSP (digital signal processor), an ASIC (application specific IC), etc., and the communication relay section 24 is connected to interconnecting portions of the first connecting section 21 and the second connecting section 22, for example, via bonding wires or the like. In this embodiment, the communication relay section 24 has IC chips, etc., sealed in a synthetic resin, and is formed into a flattened box-like shape.

The communication relay section 24 identifies the presence or absence of the connection portions 23*a* of the communication address setting section 23 from the voltage levels of the setting terminals 24*a*1 to 24*a*3, and identifies the conducting pattern on the basis of this presence/absence identifying result, and compares this conducting pattern with a predetermined communication address table, and identifies the communication address for the electronic control device 30. Incidentally, the communication address table is stored in an internal memory or the like, and is used for identifying one communication address from the conducting pattern.

When the first connecting section 21 receives first information corresponding to the communication address designated by the communication address setting section 23, the communication relay section 24 transmits the first information to the electronic equipment 40 from the lead frames 22*a* of the second connecting section 21 designated by circuit identification data contained in the first information, and also adds the circuit identification data (designating the lead frames 22*a*) and the above communication address to second information received by the lead frames 22*a* of the second connecting section 22, and transmits this second information from the first connecting section 21 to the electronic control device 30.

The relay connector unit 1 of the above construction is assembled in the following manner. First, the wires 6 are held in the wire holding portion 13 provided at the cover portion 12. Then, the communication relay apparatus 20 is inserted into the unit housing 11 through the opening 16 of the housing 10. At this time, the communication address setting section 23 is not covered with the cover portion 12, and therefore is exposed in such a manner that it can be viewed from the exterior. Therefore, the worker or the like can visually confirm from the exterior whether the conduction of each of the plurality of connection portions 23*a* is present or absent, and also can set or change the conducting pattern. Therefore, in this embodiment, the opening 16 of the unit housing 11 serves as an exposing section.

When the setting or changing operation for the communication address setting section 23 is finished, the cover portion 12 is gradually moved toward the opening 16. As a result, each of the wires 6 received in the wire receiving grooves of the wire holding portion 13 is gradually inserted between the press-contacting blades of the upstanding portion 21*c* of the corresponding press-contacting terminal 21*a*. Then, when the cover portion 12 is attached to the unit housing 11 to completely close the opening 16, each wire 6 is press-fitted into the gap between the press-contacting blades 25 of the corresponding press-contacting terminal 21*a*, so that the press-contacting blades 25 cut the sheath of the wire 6, and are brought into contact with the conductor of the wire 6.

Figure 5:
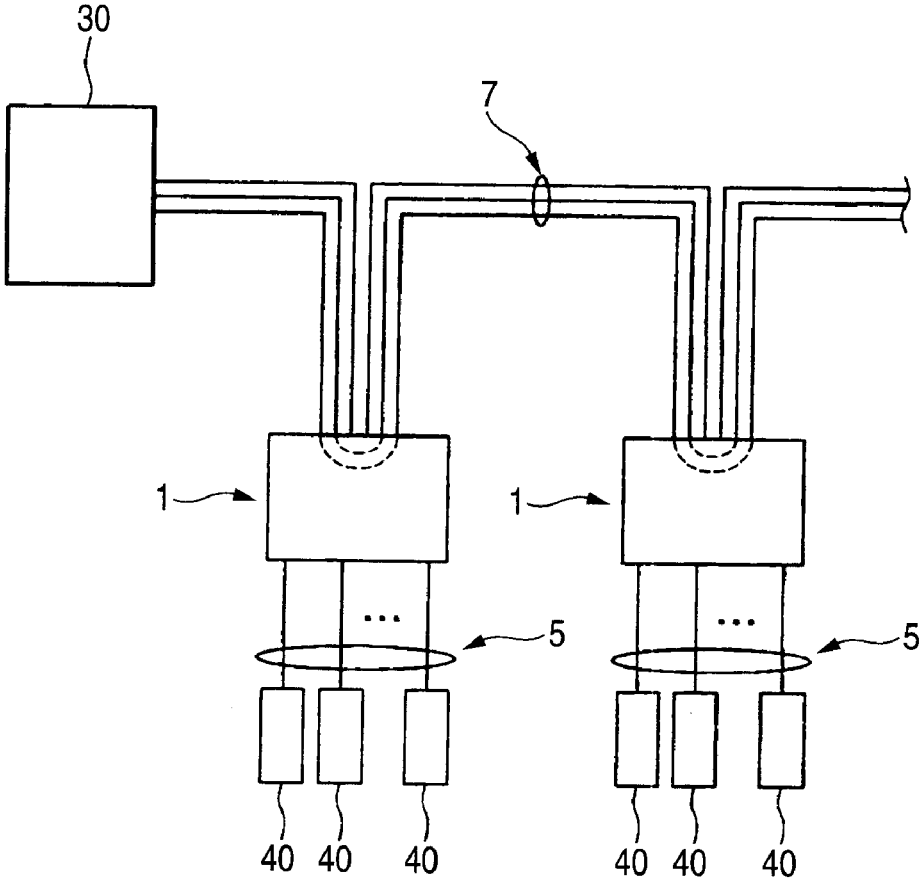
FIG. 5 is a diagram showing a communication system in which the relay connector units are incorporated.

After the relay connector unit 1 of the above construction is thus assembled, this relay connector unit 1 is fitted to the mating connector 2, and the first wire harness 7 is electrically connected to the first connecting section 21 of the communication relay apparatus 20, while the second wire harness 5 is electrically connected to the second connecting section 22. As a result, as shown in FIG. 5, the relay connector unit 1 is communicably connected to the electronic control device 30 via the first wire harness 7, and also is communicably connected via the second wire harness 5 to the plurality of electronic equipments 40 whose operations, etc., are controlled by the electronic control device 30. The communication relay section 24 relays the communication between the electronic control device 30 and the plurality of electronic equipments 40 on the basis of the communication address set by the communication address setting section 23.

As described above, in the relay connector unit 1 of the invention, for example, at the time of connecting the first wire harness 7 to the first connecting section 21 or at a later time, the conducting pattern of the plurality of connection portions 23 can be set or changed, and besides this conducting pattern can be confirmed with the eyes from the exterior. Therefore, a plurality of communication relay apparatuses 20 can be formed into a common design before the first wire harness 7 is connected to each communication relay apparatus 20, and therefore the production cost for the communication relay apparatuses 20 can be reduced. And besides, the conducting pattern can be visually confirmed from the exterior, and therefore the efficiency of the assembling operation can be enhanced, and abnormality due to the erroneous assembling, etc., can be prevented. Therefore, the erroneous assembling can be prevented, and also the common design can be achieved.

Second Embodiment

In the above first embodiment, although the conducting pattern is set by removing the connection portion(s) 23*a* of the communication address setting section 23, a second embodiment is directed to a construction in which the conducting pattern can be set or changed using conducting terminals. The second embodiment is identical in basic construction to the first embodiment, and therefore those portions identical or corresponding to those of the above first embodiment will be designated by identical reference numerals, respectively, and detailed description thereof will be omitted.

Figure 6:
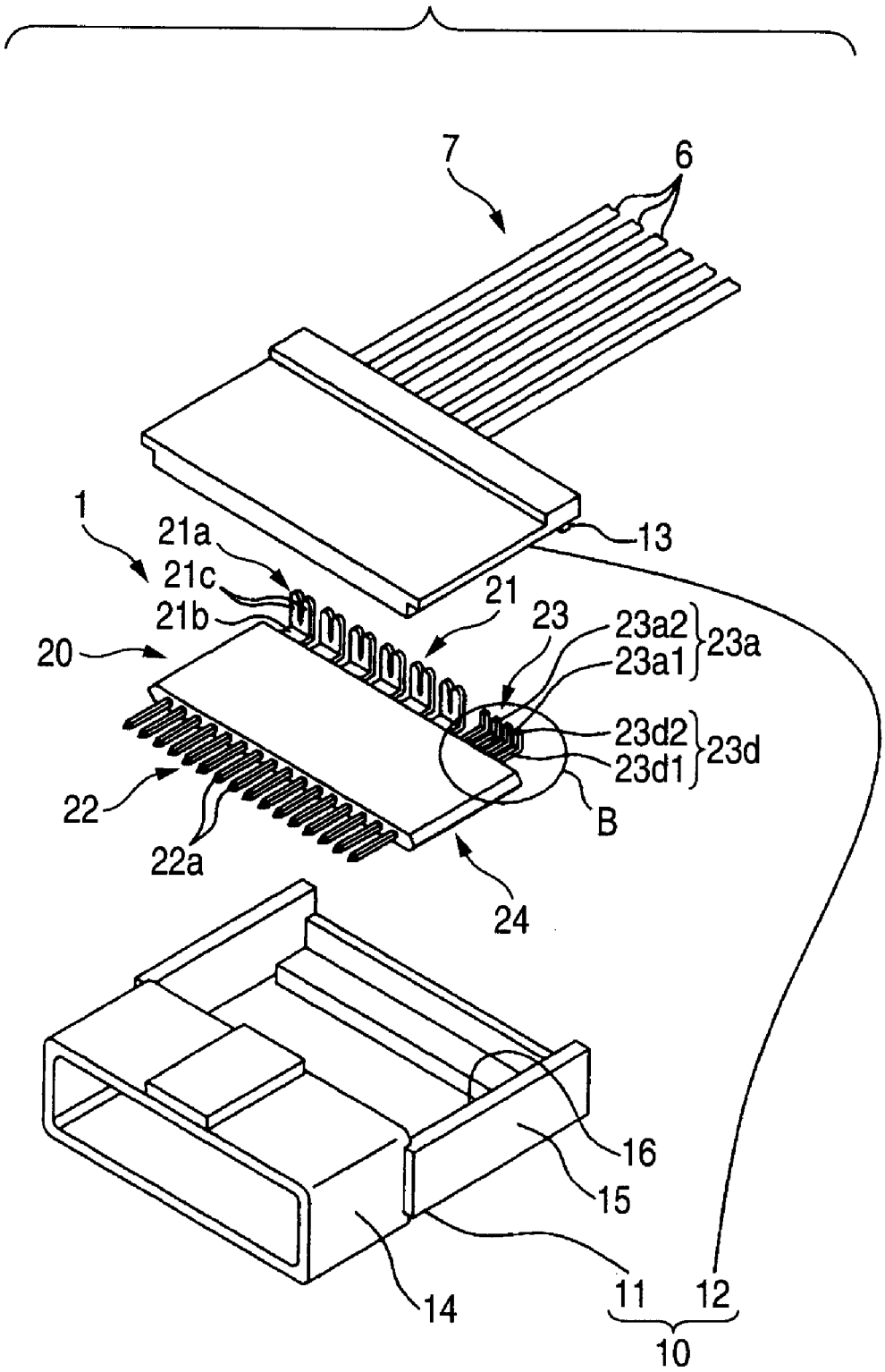
FIG. 6 is an exploded perspective view of a relay connector unit of a communication relay apparatus according to a second embodiment of the invention.

A relay connector unit 1 shown in FIG. 6 includes a housing 10, and a communication relay apparatus 20 received in the housing 10. The housing 10 is formed into a flattened box-like shape, and includes a unit housing 11, and a cover portion 12. The communication relay apparatus 20 includes a first connecting section 21, a second connecting section 22, a communication address setting section 23, and a communication relay section 24.

Figure 7:
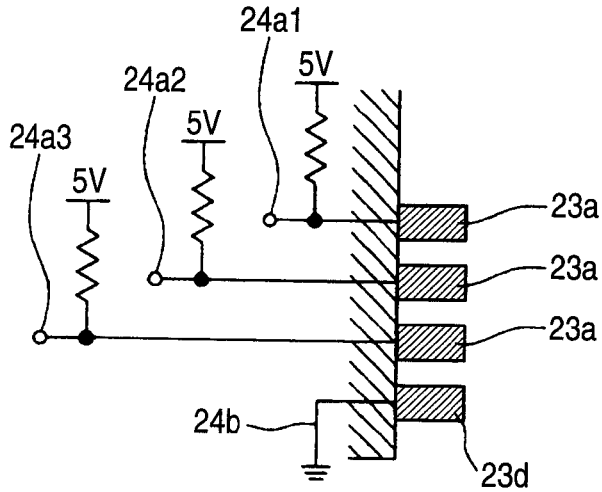
FIG. 7 is a diagrammatic illustration explanatory of a construction of a portion B of FIG. 6.
Figure 8:
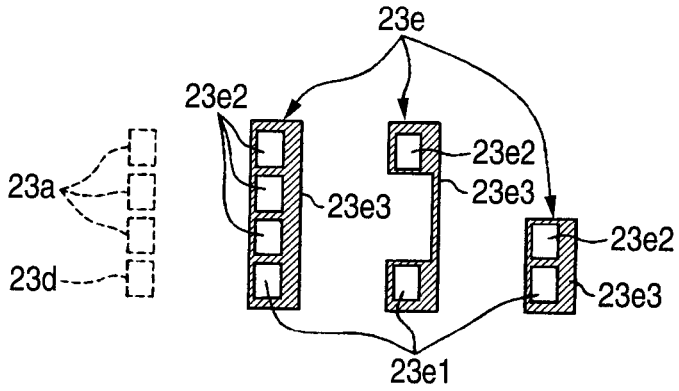
FIG. 8 is a view showing examples of conducting terminals for mounting on connection portions.

As shown in FIG. 6, the communication address setting section 23 is formed integrally on the communication relay section 24, and more specifically projects outwardly from a side edge of the communication relay section 24 in parallel relation to parallel portions 21*b* of the first connecting section 21 so that this communication address setting section 23 can be viewed from the exterior. As shown in FIGS. 6 to 8, the communication address setting section 23 includes a plurality of (three in the drawings) connection portions 23*a*, a grounding portion 23*d*, and a plurality of kinds (only three of which are shown in the drawings) of conducting terminals 23*e*, the connection portions 23*a*, the grounding portion 23*d* and the conducting terminals 23*e* being made of an electrically-conductive material.

Each of the connection portions 23*a* has a strip-like shape, and these connection portions 23*a* are electrically connected at their one ends to setting terminals 24*a*1 to 24*a*3 of the communication relay section 24, respectively. The connection portion 23*a* includes a base portion 23*a*1, and a mounting portion 23*a*2 formed integrally with the base portion 23*a*1. The base portion 23*a* has a strip-like shape, and its opposite sides (faces) are disposed generally in coplanar relation to opposite sides (faces) of the communication relay section 24, respectively. The plurality of base portions 23*a*1 are arranged at predetermined intervals in parallel relation to one another.

The mounting portion 23*a*2 extends upwardly from that end of the base portion 23*a*1 remote from the communication relay section 24. Opposite sides (faces) of the mounting portion 23*a*2 are disposed perpendicular to the opposite sides of the base portion 23*a*1. The mounting portions 23*a*2 are sufficiently long that the conducting terminal 23*e* can be mounted on the mounting portions 23*a*2 and can be held thereon. Like the connection portion 23*a*, the grounding portion 23*d* includes a base portion 23*d*1, and a mounting portion 23*d*2 formed integrally with the base portion 23*d*1. The base portion 23*d*1 and the mounting portion 23*d*2 are identical in construction to the base portion 23*a*1 and the mounting portion 23*a*2, respectively.

The conducting terminals 23*e* include a first through hole 23*e*1 for the passage of the grounding portion 23*d* therethrough, one or more second through holes 23*e*2 for the passage of the connection portion(s) 23*a* therethrough, and an interconnecting portion 23*e* interconnecting the first through hole 23*e*1 and the second through hole(s) 23*e*2. In the case where one or more connection portions 23*a* are to be grounded so as to correspond to a desired set value of the communication address, the second through hole or holes 23*e*2 are so formed as to correspond to such connection portion or portions 23*a*. The interconnecting portion 23*e*3 interconnects the first through hole 23*e*1 and the second through hole or holes 23*e*2 so that the first through hole 23*e*1 can be located at the grounding portion 23*d*, while the second through hole(s) 23*e*2 can be located at the corresponding contact portion(s) 23*a*. Thus, the conducting terminal 23*e* serves as a member for selectively electrically connecting the grounding portion 23*d* to the connection portion or portions 23*a* according to a desired communication address. Therefore, in the second embodiment, in order to set eight communication addresses (0 to 7) in terms of binary numbers, seven kinds of conducting terminals 23*e* are beforehand prepared.

The selected conducting terminal 23*e* is mounted on the communication address setting section 23, and the connection portion or portions 23*a* corresponding to the desired communication address are electrically connected to the grounding portion 23*d* via the conducting terminal 23*e*, and a predetermined voltage (for example, 5V) is applied to each connection portion 23*a*. Each connection portion 23*a* is grounded via a grounding line 24*b*, and therefore is held at a low level. Namely, in the communication relay section 24, when one or more connection portions 23*a* in the conducting condition are present, the corresponding setting terminal or terminals (24*a*1 to 24*a*3) are detected as the low level.

The connection portion or portions 23*a* which are not passed through the second through hole or holes 23*e*2 of the conducting terminal 23*e* are not conductively connected to the grounding line 24*b*, and therefore their potential is held at the high level. Namely, in the communication relay section 24, the setting terminal or terminals (24*a* to 24*a*3) connected to such connection portion or portions 23*a* are detected as the high level.

Thus, the communication address setting section 23 can set the communication address for the electronic control device by the conducting pattern based on the presence or absence of conduction at the plurality of connection portions 23*a* with the use of the selected conducting terminal 23*e*, and therefore the present or absence of the conduction of the plurality of connection portions 23*a* can be viewed from the exterior through the shape, etc., of the selected conducting terminal 23*e*.

The relay connector unit 1 of the above construction is assembled in the following manner. First, wires 6 are held in the wire holding portion 13 provided at the cover portion 12. Then, the communication relay apparatus 20 is inserted into the unit housing 11 through an opening 16 of the housing 10. At this time, the communication address setting section 23 is not covered with the cover portion 12, and therefore is exposed so that it can be viewed from the exterior. Therefore, the worker or the like can view the presence or absence of the conduction of the plurality of connection portions 23*a* from the exterior, and also can set or change the conducting pattern. Therefore, in the second embodiment, also, the opening 16 of the unit housing 11 serves as the exposing section.

The conducting terminal 23*e* is mounted on the communication address setting section 23, that is, is fitted on the mounting portion 23*d*2 of the grounding portion 23*d* and the mounting portion(s) 23*a*2 of the connection portion(s) 23*a*, thereby setting the communication address. Namely, when "7" in terms of binary numbers is to be set as the communication address value, all of the three connection portions 23*a* are electrically connected to the grounding portion 23*d* by the conducting terminal 23*e*. When "0" in terms of binary numbers is to be set as the communication address value, any conducting terminal 23*e* is not mounted on the communication address setting section 23.

After the setting of the communication address is finished, the cover portion 12 is gradually moved toward the opening 16. As a result, each of the wires 6 received in wire receiving grooves of the wire holding portion 13 is gradually inserted between press-contacting blades of an upstanding portion 21*c* of a corresponding press-contacting blade 21. Then, when the cover portion 12 is attached to the unit housing 11 to completely close the opening 16, each wire 6 is press-fitted into a gap between the press-contacting blades 25 of the corresponding press-contacting terminal 21*a*, so that the press-contacting blades 25 cut a sheath of the wire 6, and are brought into contact with a conductor of the wire 6.

After the relay connector unit 1 of the above construction is thus assembled, this relay connector unit 1 is fitted to a mating connector 2, and a first wire harness 7 is electrically connected to the first connecting section 21 of the communication relay apparatus 20, while a second wire harness 5 is electrically connected to the second connecting section 22. As a result, as shown in FIG. 5, the relay connector unit 1 is communicably connected to the electronic control device 30 via the first wire harness 7, and also is communicably connected via the second wire harness 5 to a plurality of electronic equipments 40 whose operations, etc., are controlled by the electronic control device 30. The communication relay section 24 relays the communication between the electronic control device 30 and the plurality of electronic equipments 40 on the basis of the communication address set by the communication address setting section 23.

As described above, in the relay connector unit 1 of the second embodiment, in addition to the advantageous effects of the first embodiment, the presence or absence of conduction at the connection portions 23*a* of the communication address setting section 23 can be set by the conducting terminal 23*e*. And besides, the presence or absence of this conducting terminal 23*e* can be viewed with the eyes, and therefore even if an error should be made in the setting of the communication address during the assembling operation, an abnormal portion in the setting operation can be identified by visually confirming the conducting pattern, and the communication relay apparatus 20 can be reused when changing the conducting pattern, and therefore the productivity and the efficiency of the maintenance can be enhanced.

In the above first and second embodiments, although the communication address setting section 23 is completely covered with the housing 10, the invention is not limited to this construction, and various modifications can be made.

Figure 9:
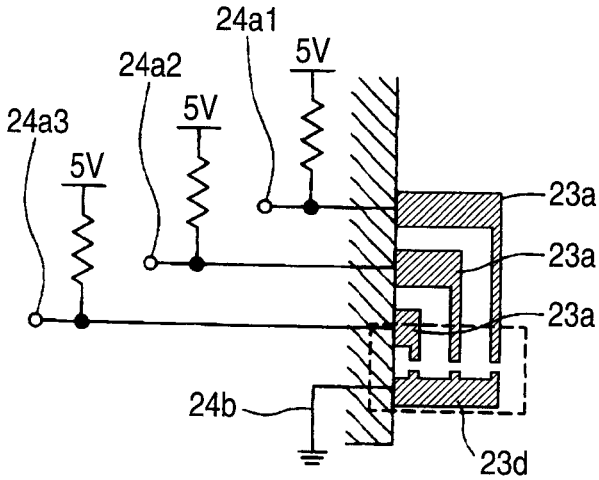
FIG. 9 is a diagrammatic illustration showing a modified construction of the portion B of FIG. 6.
Figure 10:
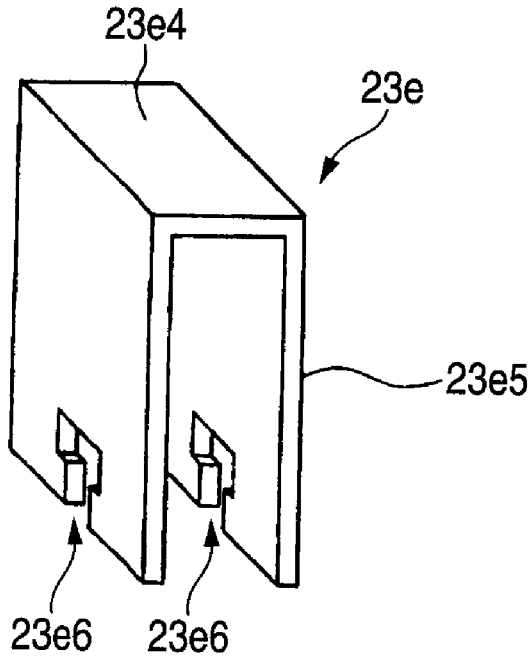
FIG. 10 is a perspective view of a conducting terminal used for conductively connecting a connection portion and a grounding portion of FIG. 10 together.

For example, the connection portions 23*a* of the communication address setting section 23 of the second embodiment can be bent as shown in FIG. 9, and in this case convex portions corresponding respectively to these connection portions 23*a* are formed on a grounding portion 23*d*, and the connection portions 23*a* are separately electrically connected to the grounding portion 23*d* by respective conducting terminals 23*e* shown in FIG. 10. The conducting terminal 23*e* includes a base portion 23*e*4, and extending portions 23*e*5 formed integrally with and extending respectively from opposite ends of the base portion 23*e*4, and fitting portions 23*e*6 are formed respectively in distal end portion of the extending portions 23*e*5.

Figure 11:
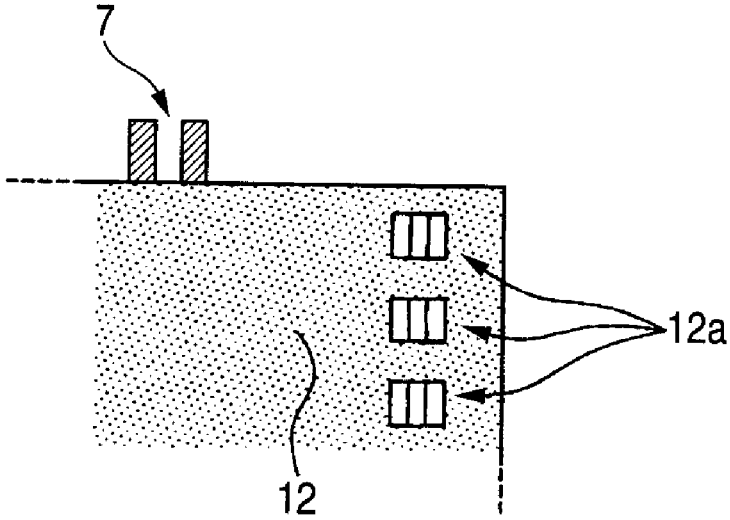
FIG. 11 is a view explanatory of mounting holes formed in a housing for the purpose of mounting the conducting terminal of FIG. 10.

Furthermore, as shown in FIG. 11, mounting holes 12*a* (serving as the exposing section) can be formed respectively in those portions of the cover portion 12 corresponding respectively to mounting positions of the conducting terminals 23*e* shown in FIG. 10, and therefore after the cover portion 12 is attached to the unit housing 11, the conducting terminals 23*e* can be mounted. With this construction, the conducting pattern of the communication address setting section 23 can be grasped merely by visually confirming the presence or absence of each conducting terminal 23*e*, and therefore the productivity and the efficiency of the maintenance can be enhanced.

The above first and second embodiments merely show representative forms of the present invention, and the invention is not limited to these embodiments. Namely, various modifications can be made without departing from the subject matter of the invention.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japan Patent Application No. 2007-136935 filed on May 23, 2007, the contents of which are incorporated herein for reference.

What is claimed is:

1. A communication relay apparatus, comprising:

a first connecting section for connecting to a first wire harness connected to an electronic control device;

a second connecting section for connecting to a second wire harness connected to a plurality of electronic equipments;

a communication address setting section which has a plurality of connection portions and sets a communication address for the electronic control device with a conducting pattern based on presence or absence of conduction at the connection portions; and a communication relay section which is electrically connected to the first connecting section, the second connecting section, and to the communication address setting section, and relays communication between the electronic control device and the electronic equipments on the basis of the communication address, wherein the communication address setting section is formed so that the presence or absence of the conduction of the connection portions can be viewed from an exterior of a housing for the communication relay apparatus and that the conducting pattern can be set from the exterior of the housing for the communication relay apparatus.

2. The communication relay apparatus according to claim 1, wherein the communication address setting section includes a conducting terminal which is detachably mounted on the connection portions and is capable of setting the presence or absence of the conduction of the connection portions.

3. A relay connector unit, comprising:

the communication relay apparatus as set forth in claim 1; and the housing which receives the communication relay apparatus therein so that the communication relay apparatus is capable of electrically connecting to the first wire harness and the second wire harness, wherein the housing includes an exposing section for exposing the communication address setting section of the communication relay apparatus so that the communication address setting section can be viewed from the exterior of the housing.

4. The communication relay apparatus according to claim 1, wherein the communication relay section identifies the communication address set by the communication address setting section by comparing the conducting pattern with a predetermined communication address table.

* * * * *